US005724938A

United States Patent [19]

Yamada

[11] Patent Number: 5,724,938

[45] Date of Patent: Mar. 10, 1998

[54] IGNITION SYSTEM FOR A TWO CYCLE ENGINE

[75] Inventor: Akira Yamada, Hamamatsu, Japan

[73] Assignee: Yamaha Hatsudoki Kabushiki Kaisha, Iwata, Japan

[21] Appl. No.: 48,580

[22] Filed: Apr. 15, 1993

Related U.S. Application Data

[63] Continuation of Ser. No. 764,531, Sep. 24, 1991, abandoned.

[30] Foreign Application Priority Data

Sep. 26, 1990 [JP] Japan ..... 2-257935

[51] Int. Cl.[6] ..... F02P 15/00

[52] U.S. Cl. ..... 123/305; 123/169 CL; 123/531; 123/637; 123/640

[58] Field of Search ..... 123/169 CL, 305, 123/531, 533, 620, 637, 640

[56] References Cited

U.S. PATENT DOCUMENTS

| | | | |
|---|---|---|---|
| 2,852,588 | 9/1958 | Hartman, Jr. | 123/652 |
| 3,165,099 | 1/1965 | Vanderpoel | 123/637 |
| 3,280,809 | 10/1966 | Issler | 123/637 X |
| 3,430,617 | 3/1969 | Elberson | 123/637 X |
| 3,824,977 | 7/1974 | Campbell et al. | 123/651 |
| 3,972,315 | 8/1976 | Munden et al. | 123/640 X |
| 4,194,479 | 3/1980 | Stackarok | 123/637 |
| 4,345,576 | 8/1982 | Moseley et al. | 123/637 X |
| 4,800,862 | 1/1989 | McKay et al. | 123/73 C X |
| 5,020,504 | 6/1991 | Morikawa | 123/531 |
| 5,048,497 | 9/1991 | Kishida et al. | 123/533 |

FOREIGN PATENT DOCUMENTS

| | | | |
|---|---|---|---|
| 112870 | 9/1980 | Japan | 123/169 CL |
| 112871 | 9/1980 | Japan | 123/169 CL |
| 112872 | 9/1980 | Japan | 123/169 CL |

*Primary Examiner*—Tony M. Argenbright

*Attorney, Agent, or Firm*—Knobbe, Martens, Olson & BearLLP

[57] ABSTRACT

The present invention relates to ignition systems for internal combustion engines and, in particular, to a spark ignition system specifically adapted for two-cycle engines. An ignition system is provided which is able to avoid ignition plug smolder and electrode contamination by providing for self-cleaning of the ignition plug electrodes and ensuring complete combustion of an injected rich mixture of fuel/air in the vicinity of the ignition plug electrodes within a combustion chamber. This is accomplished by employing two distinct, yet interrelated, ignition plug firing systems. One such system causes an ignition plug to emit a spark of long duration when an air/fuel charge is present in the combustion chamber, thereby ensuring good combustion. The other system causes the ignition plug to emit a spark of short duration and of very high energy when little, or no, charge is present in the combustion chamber, thereby aiding in the self-cleaning of the electrodes of the ignition plug.

37 Claims, 7 Drawing Sheets

IGNITION SYSTEM FOR A TWO CYCLE ENGINE

This is a continuation of U.S. patent application Ser. No. 2/764,531, filed Sep. 24, 1991, entitled "IGNITION SYSTEM FOR THE TWO CYCLE ENGINE", now abandoned.

BACKGROUND OF THE INVENTION

The present invention relates to ignition systems for internal combustion engines and, in particular, to a spark ignition system specifically adapted for two-cycle engines.

The air and fuel mixture in an engine combustion chamber must be ignited at a precise time during the stroke of the cylinder. This is normally accomplished by providing an electrical spark which jumps a gap of an ignition plug located within the combustion chamber. A high voltage (e.g., 5,000 to 50,000 volts) is required in order to force the electrical current to jump the ignition plug gap. However, the usual battery associated with an engine provides only a much lower voltage (e.g., 12 volts). Thus, an ignition system is utilized to increase the voltage to the necessary amount at the right time for the spark to occur.

Ignition systems have developed and changed over time. The conventional ignition system has used a mechanical set of points and condensers to accomplish its purpose. More recently, electronic ignition systems have been developed and employed which use semiconductors and transistors. Further, computer-controlled systems have been developed which work directly with such electronic ignition systems.

In order to mix the correct amount of fuel and air in the combustion chamber for igniting, traditionally, a carburetor has been employed in an induction type system. However, more precise methods have developed which provide for lower emissions and higher performance. One such method involves the direct injection of fuel, or a fuel/air mixture, into the combustion chamber. Such direct injection can measure precisely the proper amount of fuel to maintain the best attainable air-fuel ratio for combustion.

Certain problems, however, may prevent ignition and injection systems from operating at their peak potential. The usual two-cycle engine employs a capacitor-discharging type ignition system. The high voltage induced on the secondary side of the ignition coil forms very rapidly in such a system. Also, the spark duration of the ignition plug is very short and the mixture igniting period lasts only for a moment with this type of ignition system. Therefore, in connection with a two-cycle engine, in which a layer of rich mixture is formed near the ignition plug electrodes for combustion upon the injection of fuel into the combustion chamber, if the mixture layer is not properly directed very proximate to the electrodes the probability of a complete combustion is greatly reduced. Soot produced by incomplete combustion is apt to adhere upon the electrodes, causing problems of ignition plug smolder and electrode contamination.

It is, therefore, an object of this invention to provide an improved ignition system for a two-cycle internal combustion engine.

It is further an object of this invention to provide an ignition system which is able to avoid ignition plug smolder and electrode contamination by providing for self-cleaning of the ignition plug electrodes and ensuring complete combustion of an injected rich mixture of fuel/air in the vicinity of the ignition plug electrodes within a combustion chamber.

SUMMARY OF THE INVENTION

An ignition system for a two-cycle engine comprises an ignition system circuit and a set of electrodes. The electrodes are in communication with the ignition system circuit. The electrodes are located within a combustion chamber of the engine. The ignition system circuit produces an electrical spark at the electrodes after a combustible charge has been introduced into the combustion chamber and, again, after the combustible charge has been ignited, and before another combustible charge is introduced, within the combustion chamber.

DETAILED DESCRIPTION OF THE PREFERRED EMBODIMENTS

Figure 1:
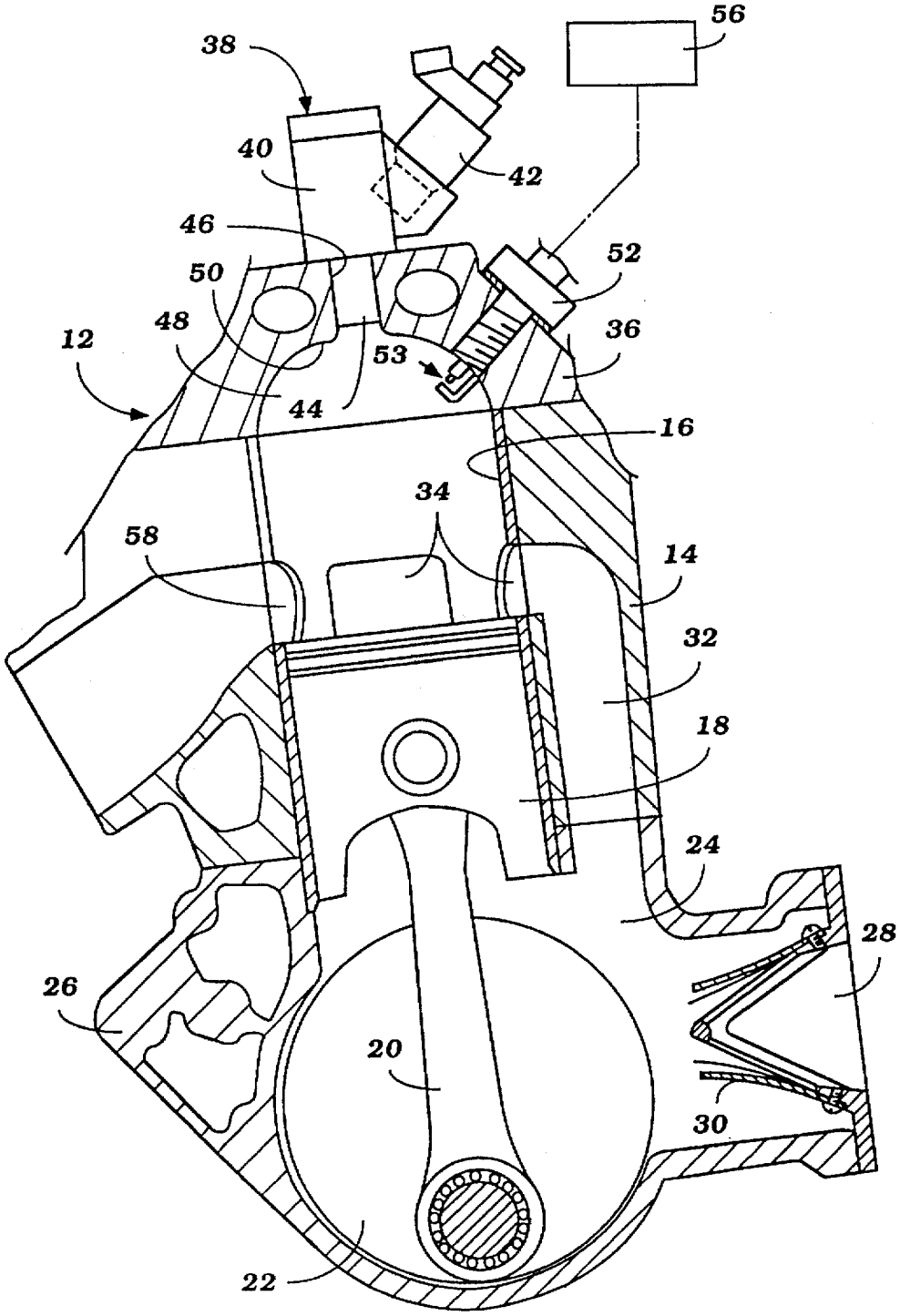
FIG. 1 is a partially schematic cross-sectional view taken along through a single cylinder of a two-cycle crankcase compression internal combustion engine having a fuel/air injection unit and an ignition system constructed in accordance with the invention.

Referring first to FIG. 1, a single cylinder of a two-cycle crankcase compression internal combustion engine having a fuel/air injection unit and an ignition system constructed in accordance with the invention is depicted generally by the reference numeral 12. Only a single cylinder of the engine 12 is depicted because it is believed that those skilled in the art can readily understand how the invention can be employed in connection with various multiple cylinder engines. Also, although the invention is described in conjunction with a two-cycle crankcase compression internal combustion engine, the invention can be equally as well practiced with other types of engines. However, the invention does have particular utility in conjunction with two-cycle engines.

The engine 12 includes a cylinder block 14 formed with a cylinder bore 16 in which a piston 18 reciprocates. The piston 18 is connected by means of a connecting rod 20 to the throw of a crankshaft, indicated at 22, for driving the crankshaft 22 in a known manner.

The crankshaft 22 is rotatably journaled within a crankcase chamber 24 that is formed by the cylinder block 14 and a crankcase 26. An air charge is delivered to the crankcase chamber 24 through an intake manifold 28. A reed type check valve 30 is interposed between the intake manifold 28 and the crankcase chamber 24 so as to preclude reverse flow, as is well known in this art. The charge which has been admitted to the crankcase chamber 24 will be compressed during downward movement of the piston 18 and is then delivered into one or more transfer for scavenge passages 32. The air charge exits the scavenge passages 32 via scavenging ports 34 into the area above the piston 18.

A cylinder head 36 is affixed to the cylinder block 14 and supports a fuel/air injection unit, indicated generally by the reference numeral 38. The fuel/air injection unit 38 has a body 40, having a portion which accommodates a fuel injector device 42. A pilot portion 44 of the fuel/air injection unit body 40 extends through a delivery passage 46 in the cylinder head 36 to communicate the fuel/air injection unit 38 with a combustion chamber 48, formed by a recess 50 within the cylinder head 36. The construction of the fuel/air injection unit 38 will be described in more detail below.

An ignition plug 52 is also provided in the cylinder head 36. The ignition plug 52 is provided with electrodes 53 which extend into the combustion chamber 48 for firing the fuel/air charge generated both by the injector unit 38 and the induction system already described. An ignition system, indicated schematically at 56 and described in detail below, controls the timing and duration of the firing of the ignition plug 52. The burnt fuel/air charge is then discharged to the atmosphere through an exhaust port 58.

Figure 2:
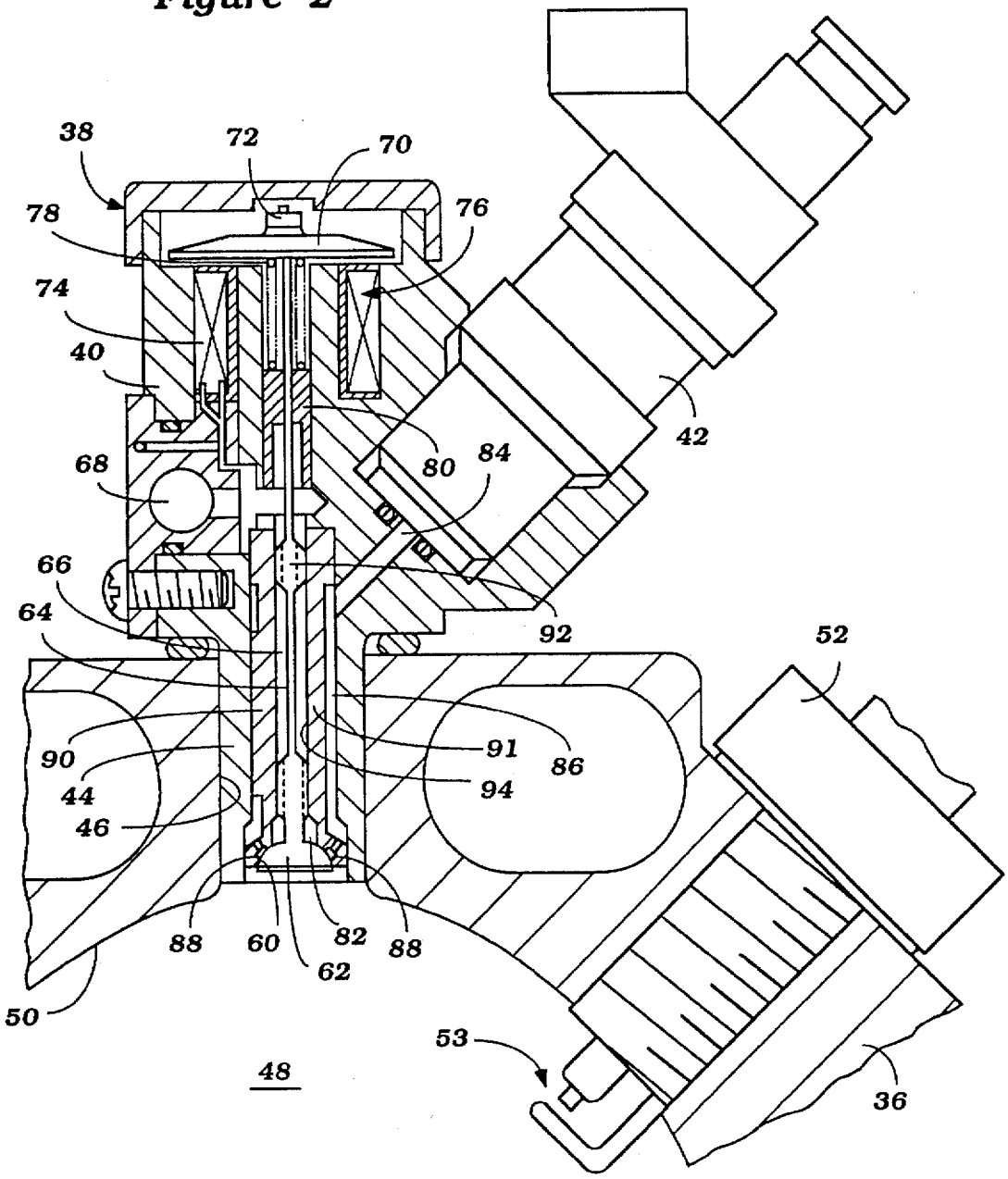
FIG. 2 is an enlarged cross-sectional view taken through an upper region of the cylinder head of the engine, including the air/fuel injection unit and ignition plug, in accordance with the invention.

The construction of the fuel/air injector unit 38 is shown in FIG. 2, and will now be described by reference to that Figure. The fuel/air injector unit 38 is comprised of an outer housing, indicated generally by the reference numeral 40 and which mounts a fuel injector 42. The housing 40 has a pilot portion 44 which extends into the delivery passage 46 of the cylinder head 36 and which defines a valve seat 60 that is opened and closed by a head portion 62 of a control valve, indicated generally by the reference numeral 64. The control valve 64 extends through the pilot portion 44 with a clearance therebetween which defines a chamber 66 to which air is delivered under pressure from an air port 68.

The control valve 64 has affixed to its upper end an armature plate 70 by means of a fastener 72. This provides an axial adjustment for the armature plate 70 on the control valve 64 to control the maximum movement of the valve head 62. A solenoid coil 74 of an electro-magnet 76 encircles the stem of the control valve 64. A coil compression spring 78 acts against a cup-shaped member 80, which member 80 has an axial passageway through which the stem of the control valve 64 passes. The opposite end of the spring 78 acts against a side of the armature 70 tending to bias the head portion 62 in its seated position until the solenoid 74 is energized.

When the solenoid 74 is energized by a control system, described below, the armature plate 70 will move downwardly until it contacts a lower surface which sets the maximum opening area for the control valve 64. Upon opening of the control valve 64, air under pressure within the air passage 66 is released into the combustion chamber 48 via an air injection nozzle 82. The fuel injector releases fuel into a fuel duct 84 according to signals received from the associated control system. The fuel then flows into a pressure chamber 86 and subsequently into the combustion chamber 48 via a fuel injection nozzle 88. A sleeve portion 90 of the fuel/air injection unit body 91 is located within the housing 40 and helps to define air and fuel passages within the fuel/air injection unit 38. An enlarged portion 92 of the control valve stem contacts the inner wall 94 of the sleeve portion 90, in order to ensure the stability of the control valve 64 both at rest and during movement.

Figure 3:
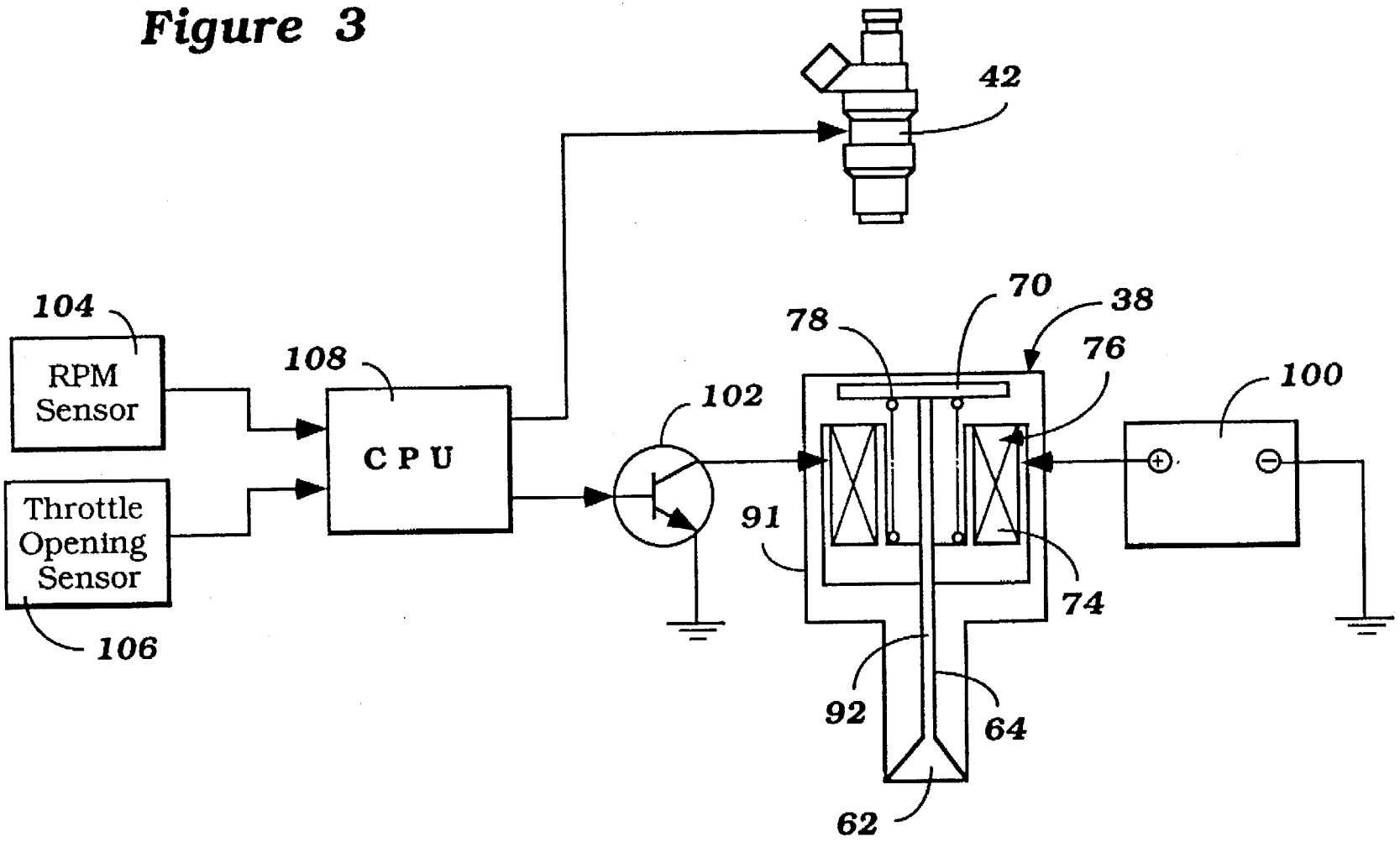
FIG. 3 is a schematic diagram showing the control system for the air/fuel injection unit of the invention.

A schematic diagram is provided as FIG. 3 showing the control system for the air/fuel injection unit 38. A battery 100 is connected to the solenoid coil 74 of the electro-magnet 76. Further, a driving circuit 102, having a transistor, is also connected to the solenoid coil 74. During engine operation, an engine RPM sensor 104 and a throttle opening sensor 106 input a signal indicating the engine RPM and a signal indicating the throttle opening, respectively, to a CPU 108. The CPU 108 is provided with a pre-set map of values for deriving the optimum injection timing and injection period for the current engine operating conditions. Thus, the CPU 108 determines from the map the optimum injection timing and injection period for the control valve 64 and the fuel injector 42 and outputs appropriate driving signal pulses to both the driving circuit 102 for the control valve 64 and to the fuel injector 42 in order to effect their operation according to such determinations.

Figure 4:
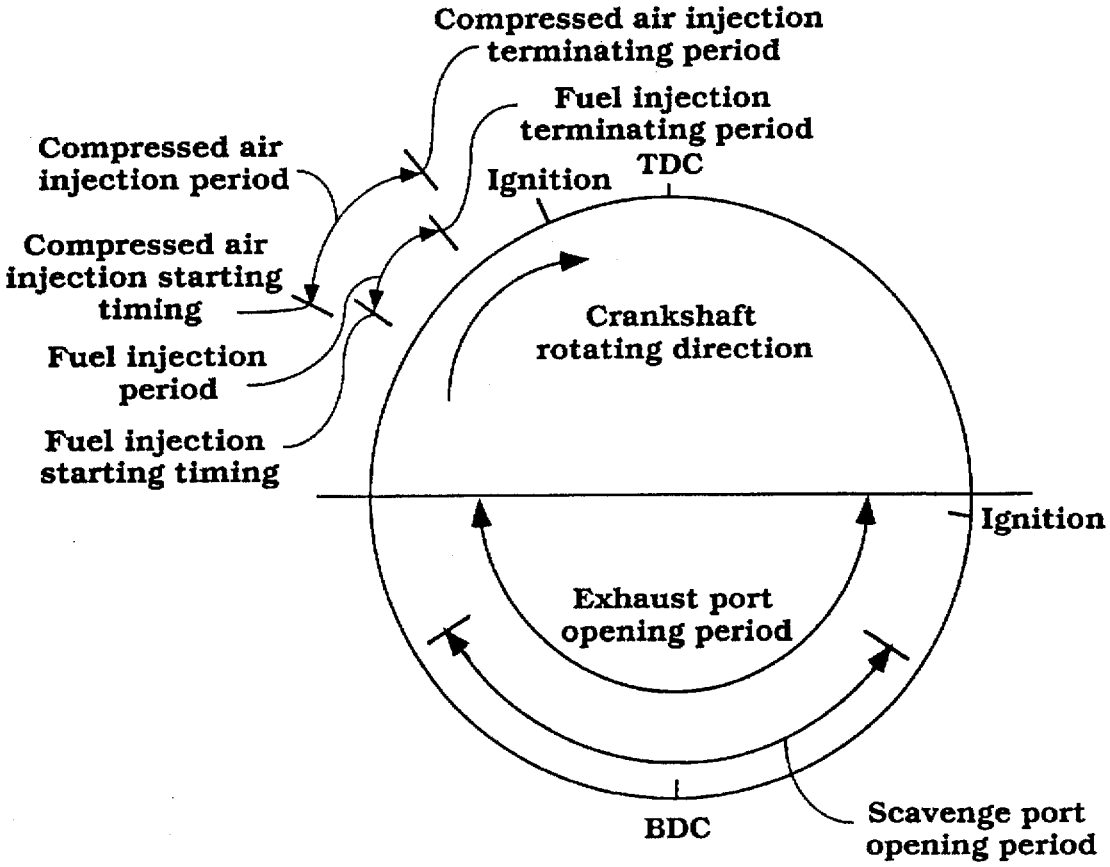
FIG. 4 is a timing diagram depicting the operation of the injection device of the invention and showing the compressed air injection period and fuel injection period in the low load, low RPM engine operating range, including idling.
Figure 5:
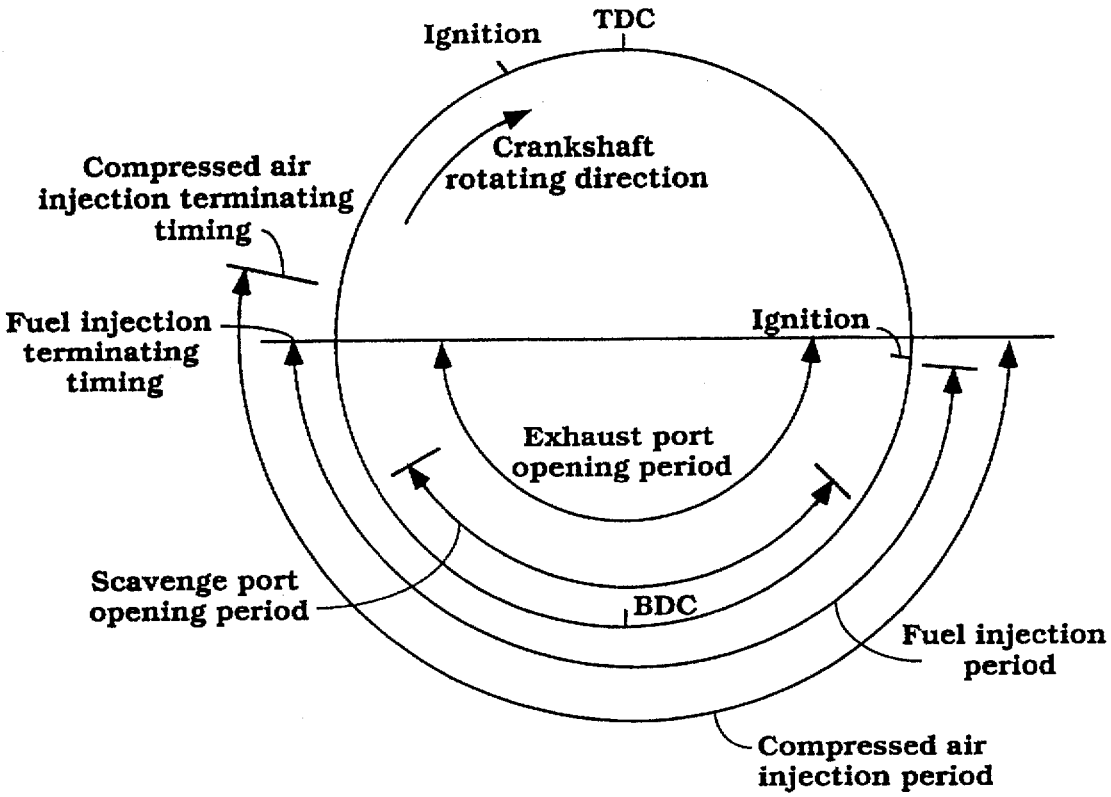
FIG. 5 is a timing diagram depicting the operation of the injection device of the invention and showing the compressed air injection period and fuel injection period in the high load, high RPM engine operating range.
Figure 6:
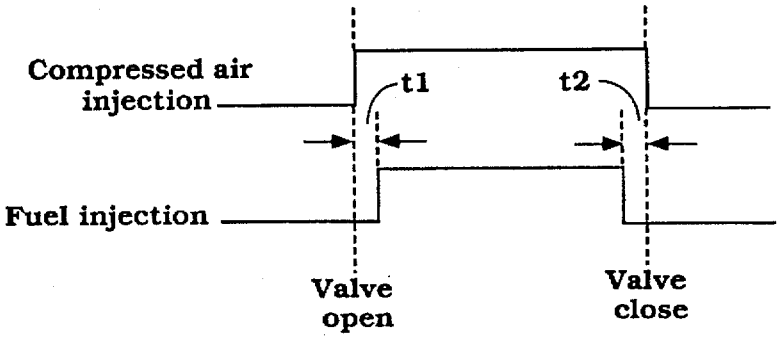
FIG. 6 is a diagram showing the injection timing of compressed air and fuel into the combustion chamber of the engine.

FIGS. 4 and 5 are timing diagrams depicting the operation of the injection device. FIG. 4 shows the compressed air injection period and fuel injection period in the low load, low RPM engine operating range, including idling. FIG. 5 shows the compressed air injection period and fuel injection period in the high load, high RPM engine operating range. FIG. 6 is a diagram showing the injection timing of compressed air and fuel into the combustion chamber 48 of the engine.

An illustrative example of the operation of the injection system will now be set forth, with further reference to the Figures, and particularly to FIG. 4. In the low load, low RPM operating range, including idling, a driving pulse is applied to the driving circuit 102 for operating the control valve 64 after the exhaust port 58 and the scavenging ports 34 are closed. At this point, as the driving circuit 108 is turned on, an electric current flows from the battery 100 through the solenoid coil 74 of the electro-magnet 76 thereby causing the armature 70 to be attracted by the electro-magnet 76. As a result, the head portion 62 of the valve 64 becomes unseated thus opening the air injection nozzle 82 and the fuel injection nozzle 88 simultaneously. Since the air passage 66 is constantly kept supplied with compressed air from an air supply source, air is injected into the combustion chamber 48 as soon as the air injection nozzle 82 is opened.

After a predetermined time $t_1$ (FIG. 6) has passed from the start of the air injection event, the fuel injector 42 is actuated and fuel is thus injected into the combustion chamber 48 via the fuel injection nozzle 88. As seen in FIG. 4, the fuel injection period is terminated before the piston 18 reaches top dead center (TDC). After a predetermined time $t_2$ has passed after the termination of fuel injection, the application of the driving pulse upon the driving circuit 102 is terminated, thereby turning off the driving circuit 102 and ending the attraction of the armature 70 towards the electro-magnet 76. This allows the armature 70 to be pushed upward by the compression coil spring 78 thus causing the valve head 62 to return to its seated, closed position. Accordingly, the air injection nozzle 82 and the fuel injection nozzle 88 are simultaneously closed, thus terminating the air injection into the combustion chamber 48.

The ignition system, depicted schematically in FIG. 1 by the reference numeral 56, will now be discussed with particular reference to FIG. 7. Generally, the ignition system discussed below causes the ignition plug 52 to emit an electric arc twice per each reciprocation of the piston 18, and it is comprised of a current-interrupting type ignition means 120 and a capacitor-discharging type ignition means 122.

The current-interrupting type ignition means 120 is a full-transistor ignition system in which a primary coil 130A of a first ignition coil 130 and the base of a first transistor 134 are connected to the battery 100. The collector of the first transistor 134 is connected to the primary coil 130A while its emitter is grounded. Thus, when an electric current from the battery 100 flows in the base of the first transistor 134 the transistor 134 is turned on and an electric current from the battery 100 then flows in the primary coil 130A of the first ignition coil 130.

The collector of a second transistor 136 is connected in a parallel fashion to the circuit connecting the battery 100 with the first transistor 134. The emitter of this transistor 136 is grounded, and a pickup coil 138 for determining the ignition timing is connected to the base of this transistor 136 through a diode 140. The pickup coil 138 issues an ignition pulse when a retractor 142 is rotated to the ignition position by the crankshaft 22. When the period of fuel injection into the combustion chamber 48 is terminated and the piston 18 reaches near the compression TDC, as shown in FIGS. 4 and 5; and, when this ignition pulse is applied on the base of the second transistor 136, the second transistor 136 is turned on and the first transistor 134 is turned off. When the electric current flowing in the primary coil 130A is interrupted when the first transistor 134 is turned off, a high voltage is generated through the secondary coil 130B of the first ignition coil 130, and this high voltage passes through a diode 144 to the ignition plug 52 and causes the electrodes 53 thereof to emit an electric spark, in order to combust the mixture present in the combustion chamber 48 near the compression TDC.

Figure 8:
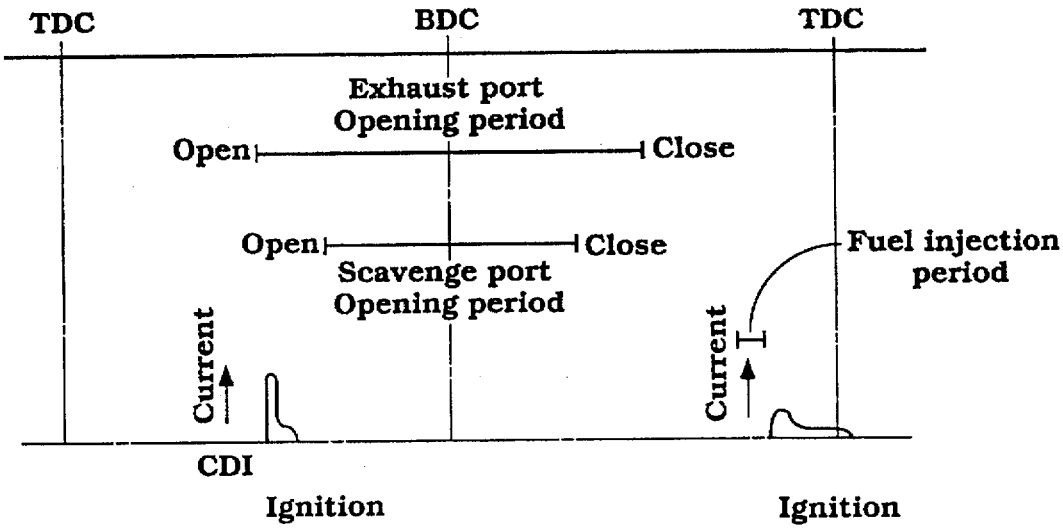
FIG. 8 is a diagram showing the ignition timing in the low load, low RPM engine operating range, including idling.
Figure 9:
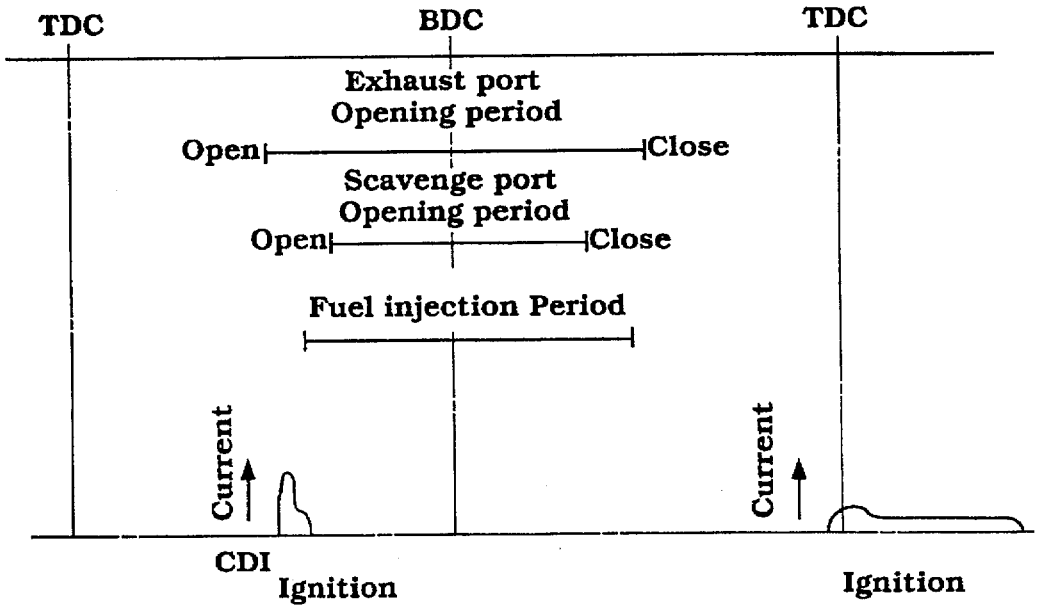
FIG. 9 is a diagram showing the ignition timing in the high load, high RPM engine operating range.

Such a current-interrupting type ignition means has the characteristic of slowly building up electric current in the secondary coil 130B of the first ignition coil 130; and providing a spark of relatively long duration, as shown in the diagrams of FIGS. 8 and 9. FIG. 8 shows the ignition timing of the ignition plug 52 in the low load, low RPM engine operation range, including idling. FIG. 9 shows the ignition timing of the ignition plug 52 in the high load, high RPM engine operation range.

Figure 7:
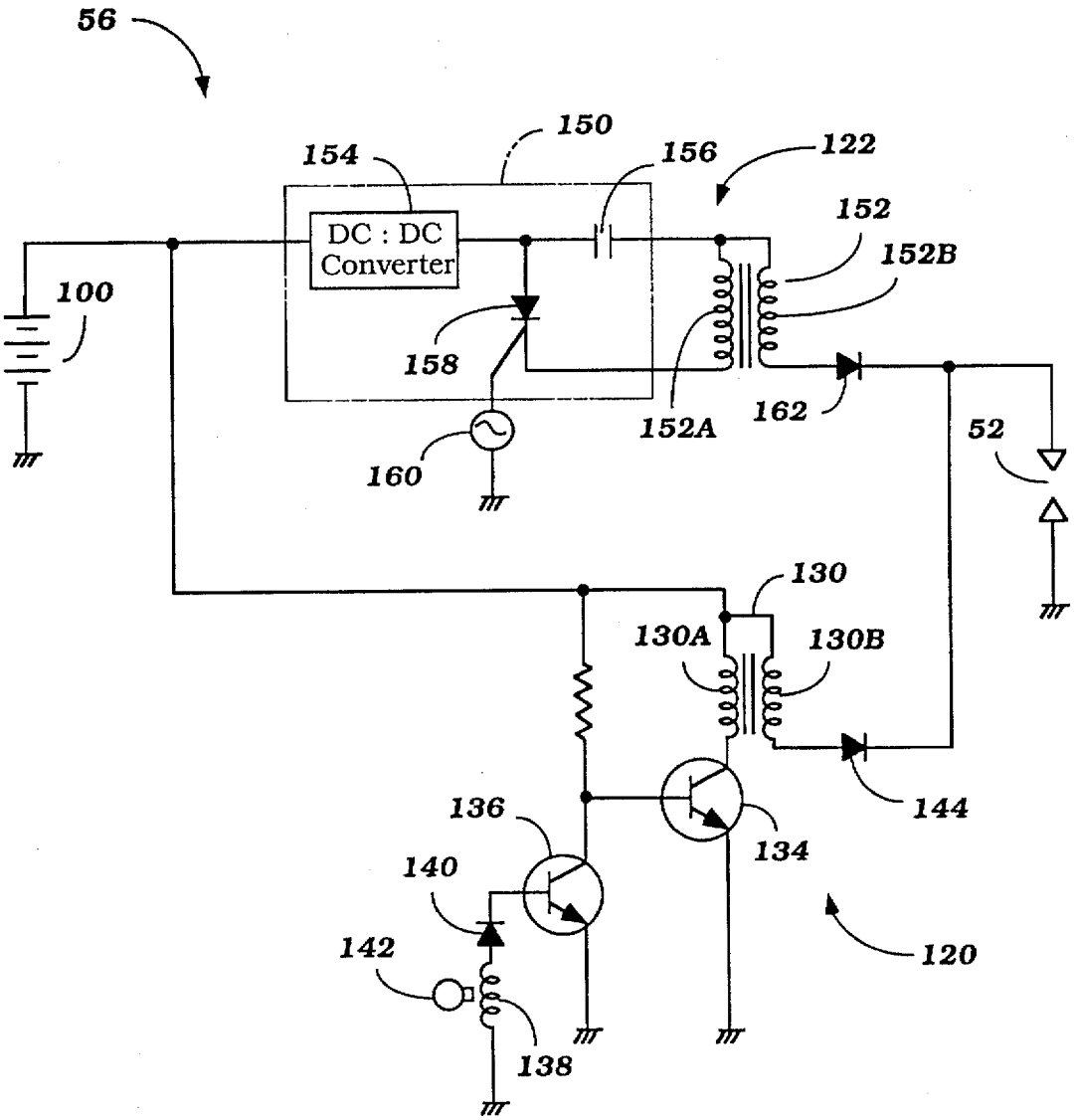
FIG. 7 is a circuit diagram of the ignition system in accordance with the invention.

The capacitor-discharging type ignition means 122, on the other hand, is a battery type capacitor discharge ignition (CDI) provided with a CDI unit 150 and a second ignition coil 152, as shown in FIG. 7. The CDI unit 150 includes a DC:DC converter 154 for raising the normal voltage from the battery 100 up to a required voltage, an ignition condenser 156 to be charged by the converter 154 and a thyrister 158 which functions as a switching element. To the gate of the thyrister 158 is connected a pulse generator 160 for determining the ignition timing. As shown in FIGS. 4, 5, 8 and 9, the pulse generator 160 issues an ignition pulse during a period between the ignition of the mixture by the current-interrupting type ignition means 120 and the subsequent initiation of fuel injection. When this ignition pulse is applied to the gate of the thyrister 158, the thyrister 158 is turned on and the ignition condenser 156 is discharged. As a result of this discharge, the electric charge stored in the ignition condenser 156 abruptly flows into the primary coil 152A of the second ignition coil 152, which in turn causes a high voltage to form through its secondary coil 152B. This high voltage passes through a diode 162 and causes the ignition plug 52 to emit an electric spark between its electrodes 53.

Such a capacitor-discharging type ignition means 122 has the characteristic of providing a larger electric current flow in its secondary coil 152B than the electric current provided in the secondary coil 130B of the current-interrupting type ignition means 120. Also, the ignition duration of the ignition plug 52 as created by the capacitor-discharging type ignition means 122 is shorter than that provided by the current-interrupting type ignition means 120.

Generally, the overall operation of the structure as set out above operates as follows. A mixture of air and fuel is formed within the combustion chamber 48 by way of the compressed air flow through the scavenging passages 32 and also by the direct injection of fuel/air therein via the injection unit 38. Following the injection of fuel into the combustion chamber 48, the current-interrupting type ignition means 120 causes the ignition plug 53 to emit an electric spark near the compression TDC in order to ignite and combust the mixture.

When the piston 18 is pushed downward within the cylinder 16 by combustion of the mixture and, as a result, the exhaust port is caused to begin to open, the capacitor-discharging type ignition means 122 causes the ignition plug 52 to emit another electric spark. It is to be noted that at the time the capacitor-discharging type ignition means 122 causes the ignition plug 52 to emit an electric spark there is no, or at least very little, combustible mixture remaining in the combustion chamber 48, since combustion has previously occurred by way of the current-interrupting type ignition means 120.

The timing at which the capacitor-discharging type ignition means 122 causes a spark within the combustion chamber 48 may be just before the exhaust port 58 begins to open; that is, immediately before the blowdown of the combusted gases begins.

The capacitor-discharging type ignition means 122 causes the ignition plug 52 to emit a more powerful and energetic spark between its electrodes 53, than that created by the current-interrupting type ignition means 120, due to the greater current flow within its secondary coil 152B. Consequently, the temperature of the ignition plug 52 quickly reaches a temperature which allows self-cleaning of the ignition plug electrodes 53 to take place. Thus, even if soot produced by the direct injection into the combustion chamber 48 adheres on the electrodes 53 of the ignition plug 52, such soot can be readily burned off and removed. In this manner, the ignition plug 52 can be cleaned in the region of its electrodes 53 each time one cycle of combustion is completed, thereby preventing the problems of ignition plug smolder and electrode contamination.

Since fuel is directly injected into the combustion chamber 48, a layer of rich mixture is formed near the electrodes 53 of the ignition plug 52 in the low load, low RPM engine operating range, including idling. It is to be noted, however, that since the current-interrupting type ignition means 122 causes the ignition plug 52 to emit an electric spark of a relatively long duration near the compression TDC, the period during which the mixture may be ignited is thereby relatively long and, accordingly, there is a relatively high probability that the mixture will be completely ignited, even under circumstances in which the layer of rich mixture is formed at a position missing the electrodes 53 of the ignition plug 52. Thus, a stable and reliable combustion of the mixture can be achieved.

Now, some alternative embodiments of the invention will be described. In the embodiment of the invention as described above, the capacitor-discharging type ignition means 122 causes the ignition plug 52 to emit an electric spark both in the high load, high RPM operating range of the engine, as well as in the low load, low RPM operating range of the engine, including idling. In an alternative embodiment of the invention, however, the capacitor-discharging type ignition means 122 may be such that it causes the ignition plug 52 to emit an electric spark only in the low load, low RPM operating range of the engine, including idling.

In an embodiment of the invention wherein the capacitor-discharging type ignition means 122 causes the ignition plug 52 to emit an electric spark in the high load, high RPM operating range of the engine, the spark may be emitted not only once during such operating conditions, but twice in succession during each cycle; or, alternatively, the spark may not be emitted during every cycle, but rather during every two or three cycles.

Although a battery-type CDI system is employed as a capacitor-discharging type ignition means 122 as described above, the capacitor-discharging type ignition means of the invention is not limited to such an arrangement. An AC-type CDI system may alternatively be employed in which the power source for charging the ignition condenser is obtained by a magnet and an exciting coil.

Similarly, the current-interrupting type ignition means 120 of the invention is not to be limited to a full-transistor ignition system, but may be, for example, a point-type battery ignition system or a semi-transistor type ignition system obtained by replacing points with transistors.

Further, although the fuel injection device 38 as described above provides a fuel passage 86 communicating with a fuel injection nozzle 88 and also an air passage 66 communicating with an air injection nozzle 82, both nozzles 82 and 88 being formed through a valve body independently of each other, the fuel injection device of this invention is not to be so limited. Rather, a passage may be provided through the valve body in which both fuel and air are passed together, the fuel and air thus being injected together from such a passage in a mixed state.

Additionally, it is not required that fuel be injected into the combustion chamber 48 in combination with compressed air. Alternatively, the fuel may be injected alone into the combustion chamber 48.

FIG. 6, discussed above, shows the injection timing of compressed air and fuel into the combustion chamber. According to this invention, however, the fuel injection timing is not meant to be so limited. The fuel injector 42 can inject fuel into the pressure chamber 86 when the control valve 64 is closed and, thus, fuel is retained within the fuel passage (the so-called "pre-charge type"). In such a system, the fuel is injected into the combustion chamber when the control valve 64 is subsequently opened. It should be noted that the pre-charging may be either of fuel alone in its own passage, such as the pressure chamber 86, or of both fuel and air together in a common chamber.

It should be readily apparent from the foregoing description that a number of embodiments of the invention have been described which provide an improved ignition system for an internal combustion engine, and, in particular, to a spark ignition system specifically adapted for a two-cycle engine. Although a number of embodiments of the invention have been described, various changes and modifications may be made from those embodiments without departing from the spirit and scope of the invention, as defined by the appended claims.

It is claimed:

1. An ignition system for an internal combustion engine comprising a combustion chamber which varies cyclically between a minimum volume condition (TDC) and a maximum volume condition (BDC), induction means for delivering a combustible charge to said combustion chamber, and exhaust means for discharging a burnt charge from said combustion chamber, said ignition system comprising an ignition system circuit and a set of electrodes in communication with said ignition system circuit, said electrodes located within said combustion chamber of said engine; said ignition system circuit producing an electrical spark at said electrodes after a combustible charge has been introduced by said induction means into said combustion chamber and as said combustion chamber approaches TDC condition for initiating combustion and a second electrical spark after said combustible charge has been ignited and burned sufficiently to leave an un-combustible mixture at said electrodes and as said combustion chamber approaches BDC condition and before another combustible charge is introduced by said induction means into said combustion chamber for serving the sole purpose of cleaning deposits from said electrodes.

2. The ignition system of claim 1 wherein the second electrical spark is initiated at approximately the time when the exhaust means begins to discharge the burnt charge from the combustion chamber.

3. The ignition system of claim 2 wherein the engine is a two cycle, crankcase, compression engine and the exhaust means comprises an exhaust port.

4. An ignition system for an internal combustion engine comprising a combustion chamber which varies cyclically between a minimum volume condition (TDC) and a maximum volume condition (BDC), induction means for delivering a combustible charge to said combustion chamber, and exhaust means for discharging a burnt charge from said combustion chamber, said ignition system comprising an ignition system circuit and a set of electrodes in communication with said ignition system circuit, said electrodes located within said combustion chamber of said engine; said ignition system circuit producing an electrical spark at said electrodes after a combustible charge has been introduced by said induction means into said combustion chamber and as said combustion chamber approaches TDC condition for initiating combustion and a second electrical spark after said combustible charge has been ignited and burned sufficiently to leave an un-combustible mixture at said electrodes and as said combustion chamber approaches BDC condition and before another combustible charge is introduced by said induction means into said combustion chamber for serving the sole purpose of cleaning deposits from said electrodes, said ignition system circuit comprising a first ignition system circuit portion, which produces said electrical spark at said electrodes when said combustible charge is present within said combustion chamber, and a second ignition system circuit portion, which produces said electrical spark at said electrodes after said combustible charge has been ignited and before another combustible charge is introduced within said combustion chamber.

5. The ignition system of claim 4 wherein said electrical spark caused by said second ignition system circuit portion has a shorter duration and has a larger electrical current flow than the electrical spark caused by said first ignition system circuit portion.

6. The ignition system of claim 5 wherein the induction means comprises a fuel injection unit extending into said combustion chamber.

7. The ignition system of claim 6 wherein said fuel injection unit injects a combustible charge into said combustion chamber; said combustible charge comprising fuel and air.

8. The ignition system of claim 5 wherein said first ignition system circuit portion is a current-interrupting type ignition system.

9. The ignition system of claim 8 wherein said current-interrupting type ignition system is a full-transistor type ignition system.

10. The ignition system of claim 8 wherein said current-interrupting type ignition system is a semi-transistor type ignition system.

11. The ignition system of claim 8 wherein said current-interrupting type ignition system is a point-type battery ignition system.

12. The ignition system of claim 5 wherein said second ignition system circuit portion is a capacitor-discharging type ignition system.

13. The ignition system of claim 12 wherein said capacitor-discharging type ignition system is a battery type capacitor discharge system.

14. The ignition system of claim 12 wherein said capacitor-discharging type ignition system is an AC-type capacitor discharge system, including an ignition condenser and a power source for charging said ignition condenser.

15. The ignition system of claim 12 wherein said capacitor-discharging type ignition system causes said ignition plug to emit an electric spark solely in a low load, low RPM operating range, including idling, of said engine.

16. The ignition system of claim 12 wherein said capacitor-discharging type ignition system causes said ignition plug to emit an electric spark both in a high load, high RPM operating range of said engine and, also, in a low load, low RPM operating range, including idling, of said engine.

17. The ignition system of claim 16 wherein said electrical spark caused by said capacitor-discharging type ignition system is emitted twice in succession during each cycle of said engine.

18. The ignition system of claim 16 wherein said electrical spark caused by said capacitor-discharging type ignition system is emitted one every N cycles of said engine, wherein N is an integer which is greater than or equal to two.

19. The ignition system for an internal combustion engine comprising an ignition system circuit and a set of electrodes in communication with said ignition system circuit, said electrodes located within a combustion chamber of said engine; said ignition system circuit comprising a first ignition system circuit portion for producing an electrical spark at said electrodes after a combustible charge has been introduced into said combustion chamber and a second ignition system circuit portion for producing an electrical spark at said electrodes after said combustible charge has been ignited and before another combustible charge is introduced within said combustion chamber, said electrical spark caused by said second ignition system circuit portion having a shorter duration and a larger electric current flow than the electrical spark caused by said first ignition system circuit portion.

20. The ignition system of claim 19 wherein said electrodes comprise a portion of an ignition plug extending into said combustion chamber.

21. The ignition system of claim 20 further comprising a fuel injection unit extending into said combustion chamber.

22. The ignition system of claim 21 wherein said fuel injection unit injects a combustible charge into said combustion chamber; said combustible charge comprising fuel.

23. The ignition system of claim 21 wherein said fuel injection unit injects a combustible charge into said combustion chamber; said combustible charge comprising fuel and air.

24. The ignition system of claim 21 further comprising a control system for controlling the operations of said fuel injection unit.

25. The ignition system of claim 24 wherein said fuel injection unit control system comprises an RPM sensor and a throttle opening sensor, said RPM sensor and said throttle opening sensor communicating their respective detected operating signals to a central processing unit.

26. The ignition system of claim 25 wherein said central processing unit is pre-set with a map of injection timing values and injection period values, said map providing an injection timing value and an injection period value corresponding to said detected RPM sensor signal and said detected throttle opening sensor signal, for controlling said fuel injection unit.

27. The ignition system of claim 24 wherein said first ignition system circuit portion is a current-interrupting type ignition system.

28. The ignition system of claim 27 wherein said current-interrupting type ignition system is a full-transistor type ignition system.

29. The ignition system of claim 27 wherein said current-interrupting type ignition system is a semi-transistor type ignition system.

30. The ignition system of claim 27 wherein said current-interrupting type ignition system is a point-type battery ignition system.

31. The ignition system of claim 24 wherein said second ignition system circuit portion is a capacitor-discharging type ignition system.

32. The ignition system of claim 31 wherein said capacitor-discharging type ignition system is a battery type capacitor discharge system.

33. The ignition system of claim 31 wherein said capacitor-discharging type ignition system is an AC-type capacitor discharge system, including an ignition condenser and a power source for charging said ignition condenser.

34. The ignition system of claim 31 wherein said capacitor-discharging type ignition system causes said ignition plug to emit an electric spark solely in a low load, low RPM operating range, including idling, of said engine.

35. The ignition system of claim 31 wherein said capacitor-discharging type ignition system causes said ignition plug to emit an electric spark both in a high load, high RPM operating range of said engine and, also, in a low load, low RPM operating range, including idling, of said engine.

36. The ignition system of claim 35 wherein said electrical spark caused by said capacitor-discharging type ignition system is emitted twice in succession during each cycle of said engine.

37. The ignition system of claim 35 wherein said electrical spark caused by said capacitor-discharging type ignition system is emitted once every N cycles of said engine, wherein N is an integer which is greater than or equal to two.

* * * * *